US005433340A

United States Patent [19]

Hoffman

[11] Patent Number: 5,433,340

[45] Date of Patent: Jul. 18, 1995

[54] VENDING DEVICE

[76] Inventor: Arlan J. Hoffman, 5137 Coldbrook Dr., Mantua, Ohio 44255

[21] Appl. No.: 228,675

[22] Filed: Apr. 18, 1994

[51] Int. Cl.[6] ..... G07F 11/60

[52] U.S. Cl. ..... 221/25; 221/69; 221/102; 221/195; 221/226; 221/312 A

[58] Field of Search ..... 221/25, 312 A, 69, 277, 221/226, 194, 195, 97, 102, 155

[56] References Cited

U.S. PATENT DOCUMENTS

| | | | |
|---|---|---|---|
| 1,905,728 | 4/1933 | Malocsay | 221/25 |
| 2,546,352 | 3/1951 | Weaver | 221/155 X |
| 3,286,879 | 11/1966 | Philippon | 221/155 X |
| 3,586,206 | 6/1971 | Gilmore et al. | 221/155 X |
| 3,762,602 | 10/1973 | Wasil | 221/195 |
| 4,671,426 | 6/1987 | Grossi | 221/69 X |
| 5,368,189 | 11/1994 | Griffith | 221/195 X |

FOREIGN PATENT DOCUMENTS

| | | | |
|---|---|---|---|
| 1048476 | 11/1966 | United Kingdom | 221/277 X |

*Primary Examiner*—William E. Terrell
*Assistant Examiner*—Dean A. Reichard
*Attorney, Agent, or Firm*—Hudak & Shunk Co.

[57] ABSTRACT

A device for vending articles includes a stack of separator panels, each of which supports a product package, positioned in a storage bin. The bin has separator panel support tabs extending into the bottom thereof, and a pivot plate containing a panel-dislodging detent is located at the bin's bottom. The lowermost panel is dislodged from the support tabs by rotation of a pin forming part of an associated coin mechanism after proper coinage has been inserted into the mechanism and its operating handle has been turned. The pin forces the plate to pivot, causing its detent to press against the separator panel, thereby dislodging the panel from the support tabs, together with its product package. Once dislodged, the separator panel falls from the device, together with the vended article, the article proceeding to an area accessible to the purchaser, and the separator panel being retained on a hanger attached to the bin.

15 Claims, 3 Drawing Sheets

VENDING DEVICE

FIELD OF THE INVENTION

This invention relates to a device for dispensing vendable articles. More particularly, this invention relates to a coin-operated vending device in which the vended articles are stored on individual panels that rest upon supports within the device until their movement from the storage location to a location at which the articles become accessible to purchasers thereof. Specifically, this invention relates to a device in which the vended articles are carried on moveable panels having a flat portion or flap which is downwardly pivotal under the weight of the articles carried thereon. During the vending process, an operating mechanism engages the pivoted flap of the lowest panel, dislodging it from its supported position, thereby causing the panel to fall from the device, and the article carried by the panel to drop to a location accessible to the would-be purchaser.

BACKGROUND OF THE INVENTION

Coin-operated machines able to release articles to purchasers thereof have long enjoyed great popularity for reasons including the fact that they can be left unattended, thereby reducing selling costs, and the fact that they are able to make sales continuously, day or night, whenever placed in a location open to the purchasing public.

Among the many different coin-operated vending machines that have been used in the past may be mentioned those consisting of a number of product-holding compartments disposed one on top of another in vertical stacks. Frequently a vending machine will hold a number of such stacks, side-by-side. During the vending operation, the bottom of the compartments lose their support due to the action of internal operating linkages, causing the product located thereon to fall from the machine to an access location.

While the use of such machines is widespread, they have the disadvantage of being inflexible with respect to the size of the product package that can be accommodated. In this regard, if the package is too large, it will not be receivable in a given compartment. On the other hand, if the compartment is larger than the product package, valuable vending space within the machine is unavailable for use.

Another type of vending machine commonly employed to sell product automatically comprises vertical bins in which product packages are stacked directly on top of each other, with no intervening supports. In the process of vending, the lowermost package is pushed from the stack through an opening and into an area where it is available to a purchaser.

Machines of the type described have the misfortune of being inflexible in that the opening through which the product is dispensed is designed for a specific package size, again making it impossible for the machine to vend packages of different sizes.

A still further type of vending machine frequently encountered positions product packages between adjacent coils of horizontal, revolving, helical spirals. In the dispensing process, the insertion of the proper coinage activates the turning of the spirals, moving product packages held thereby to a point at which they are discharged from the coils and free to fall to a location accessible by purchasers.

Again, such machines are inflexible in that the space between adjacent coils of the spirals determines the size of packages that can be accommodated. If a package is too large, it will not fit between the coils, while if it is too small, it will not be properly held in the coils, and thus will not be correctly propelled to the discharge location.

In view of the preceding, it is a first aspect of this invention to provide a vending device that has the capability of vending different size packages.

A second aspect of this invention is to provide a vending machine able to dispense product contained in small packages having variable geometry, such as small envelopes containing individual servings of powdered beverage concentrates.

Another aspect of this invention is to provide a vending device that stores vendable product in product bins on movable support panels until it is delivered to purchasers.

Another aspect of this invention is to provide a vending device in which the product supports are retained on a storage hanger following the dispensing process until the device is again reloaded with product.

An additional aspect of this invention is to provide a vending device in which the vending process once activated is operated by the action of gravity.

Yet an additional aspect of this invention is to provide a vending device that facilitates product loading procedures.

Still another aspect of this invention is to provide a vending device that has simple operating mechanics, contains few operating components, and is easy and inexpensive to construct.

BRIEF DESCRIPTION OF THE INVENTION

The preceding and other desirable aspects of the invention, as will be evident from the remainder of the specification are achieved in a device for vending articles to purchasers comprising housing means and article separator means within the housing means for supporting and separating the articles. The separator means is movable from a first position in which support for the separator means is provided, to a second position in which the separator means is unsupported, allowing it and the articles supported by it to fall from the housing means. The device also includes support means associated with the housing means to support the article separator means and product contained thereon, as well as dislodgement means for dislodging the separator means from the support means, and means for activating the dislodgement means.

The above and still other aspects of the invention are provided by a device for vending articles comprising a bin having an open bottom and a plurality of separator panels within the bin, adapted to carry and separate vendable articles stored therein.

The panels include a flap forming a portion thereof that is pivotable downwardly when vendable articles rest thereon. The panels are movable from a first position in which support for the panels and the bin is provided, to a second position in which the panels are unsupported and free to fall from the bin, together with the vended articles. Support members are provided for supporting the panels within the bin, and a dislodgement member is included having a detent extending therefrom, the detent being adapted upon activation of the dislodgement member to engage the downwardly pivoted flap, causing dislodgement of the panel from the support members, and the discharge of articles supported thereby. A coin-operated mechanism for activating the dislodgement members also forms part of the device.

DETAILED DESCRIPTION OF THE INVENTION

Figure 1:
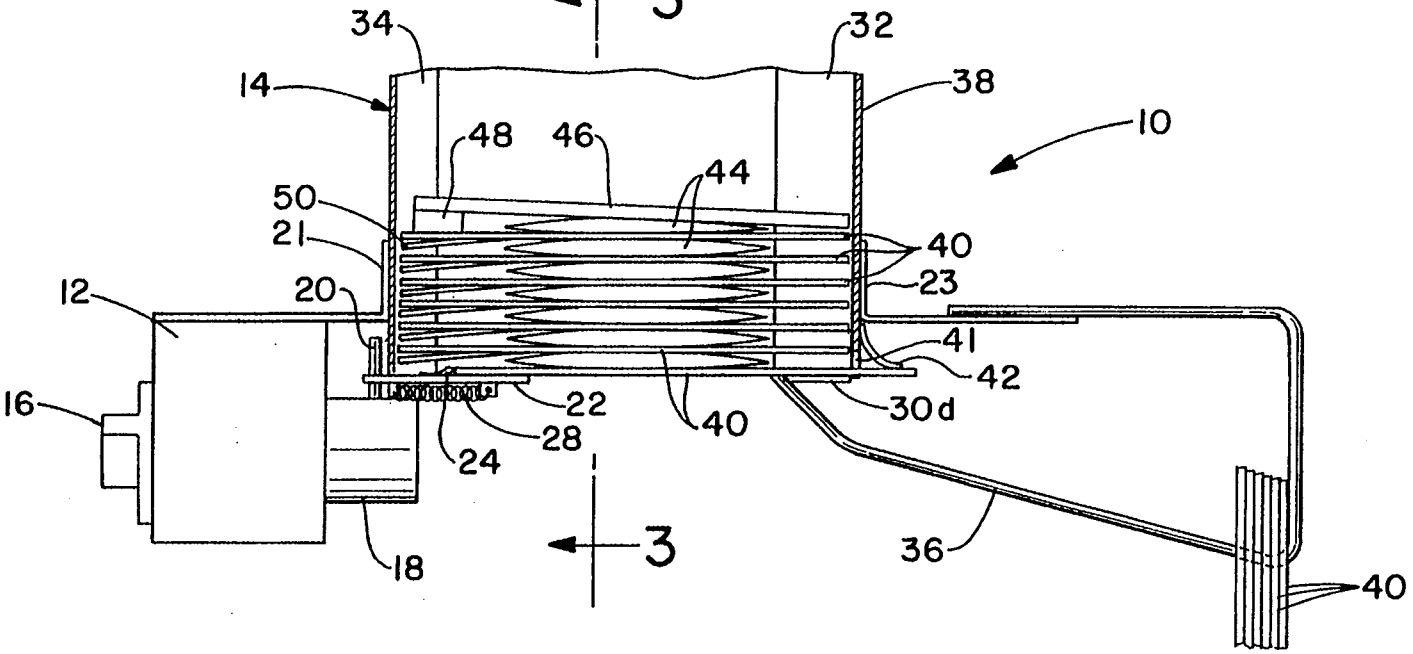
FIG. 1 is a side elevation view, partially broken away, of a product dispensing device forming the invention.

FIG. 1 is a side elevational view, partially broken away of a product dispensing device forming the invention. As shown, the device, generally 10, comprises a coin mechanism 12 having an operating handle 16 connected to an operating cylinder 18 from which extends a coupling pin 20. Upon rotation of the operating handle 16 and the consequent rotation of operating cylinder 18, the coupling pin 20 activates the dispensing device 10 by partially rotating pivot plate 22, forcing detent 24 to engage and push the lower-most separator 40 to the right, through port 41 and past a flexible separator panel-retaining flap 42. As the location of the separator panel proceeds beyond a critical point, i.e., the edge of separator panel support tabs **30*a* and 30*b*, better seen in FIG. 2, the left end of the separator panel 40 is free to fall from the device 10, allowing the product 44 held by the separator panel to fall from the device. While the left end of the separator panels falls from the device, the right-hand portion is retained on separator panel storage hanger 36**, along which it slides to a captive position on the right side of the hanger.

Following dispensing of product as described, pivot plate spring 28 forces detent 24 back into its non-engaging position, and a new separator panel with its included product drops downwardly into the lowermost position, where it remains available for a dispensing sequence.

Figure 4:
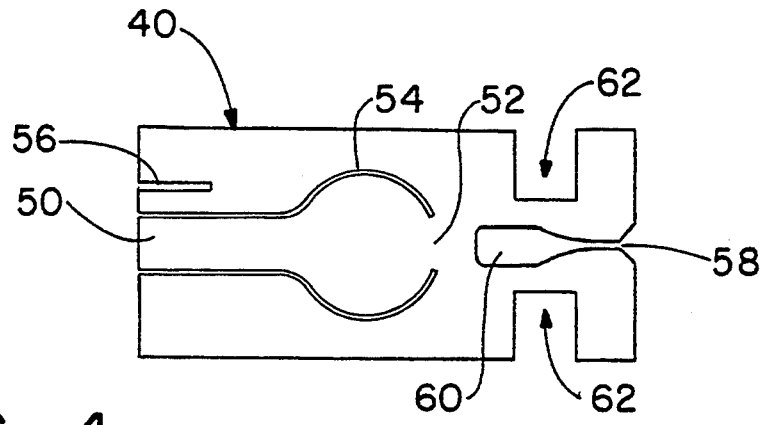
FIG. 4 is a top plan view of a separator panel forming an important element of the invention.

The separator panels 40 comprise a separator panel flap 50, better seen in FIG. 4, against which the detent 24 presses when the coin mechanism 12 is activated by insertion of the proper coinage and its operating handle 16 is rotated. The coin mechanism 12 is attached to the dispensing device 14 by means of a mounting bracket 21, while the separator storage hanger 36 is connected to the dispensing device by a similar bracket 23, as shown. The separator panel flaps 50 are depressed from the plane of the separator panels 40 as a consequence of the weight of the product 44 thereon, and movement of the separator plates proceeds downwardly in the housing bin 38 due to their weight, as well as the weight of the product 44 thereon, and the pressure exerted by weight plate 46.

The weight plate 46 has a blocking tab 48 attached to one end thereof which jams the mechanism upon the dispensing of the last package of product 44, preventing further operation of the dispensing device until it is reloaded with product. The separator panels 40 and the product 44 are positioned in the housing bin 38, and an orderly descent of the separator panels is assured as a consequence of guide flanges 32 and 34, forming part of the housing 38, which are received into mating slots in the separator panel, better seen in FIG. 4.

Although a coin mechanism similar to that shown in U.S. Pat. No. 5,188,027 is illustrated in the Figure, the device is not limited to such a coin mechanism, but may be operated by any mechanism capable of displacing the lower-most separator panel 40, as described.

The vending device and its associated dispensing mechanism may include dimensions varying within a relatively broad range, depending upon the nature of the items to be vended and similar considerations; however, it has been found convenient to employ a housing having a width of about $2\frac{1}{2}$ to 3 inches, and a length of from about $5\frac{1}{4}$ to $5\frac{3}{4}$ inches. The height of the housing bin 3 will depend upon the number of product 44 items which it is intended to make available for sale.

Similarly, the configuration of the storage hanger 36 is relatively unimportant; however, it is often desirable to employ a hanger having a downward tilt of from about 10° to 20° from the horizontal to assure movement of the support panels by gravity to the storage position shown at the right-hand side of the Figure. Although other diameters may be used, a hanger having a diameter of from about $\frac{1}{4}$ inch to $\frac{3}{8}$ inch provides adequate support for hanger storage. The weight plate 46 will conveniently be heavy enough to assure that the separator panels 40 and the product packages 44 contained thereon will move easily downwardly through the housing 38 by the action of gravity. The dimensions of the blocking tab 48 may also be varied, but the use of a tab having a height and width of about $\frac{1}{4}$ inch has been found to be adequate.

The separator retaining flap 42 may also take a number of forms; however, the use of a flap covering a separator panel exit port 41 at least about $\frac{1}{4}$ inch high is preferred.

A variety of materials may be employed to fabricate the dispensing device 14, for example, such as metal or plastic; however, the use of sheet metal provides desirable rigidity and strength, and is the material of choice for the purpose.

Figure 2:
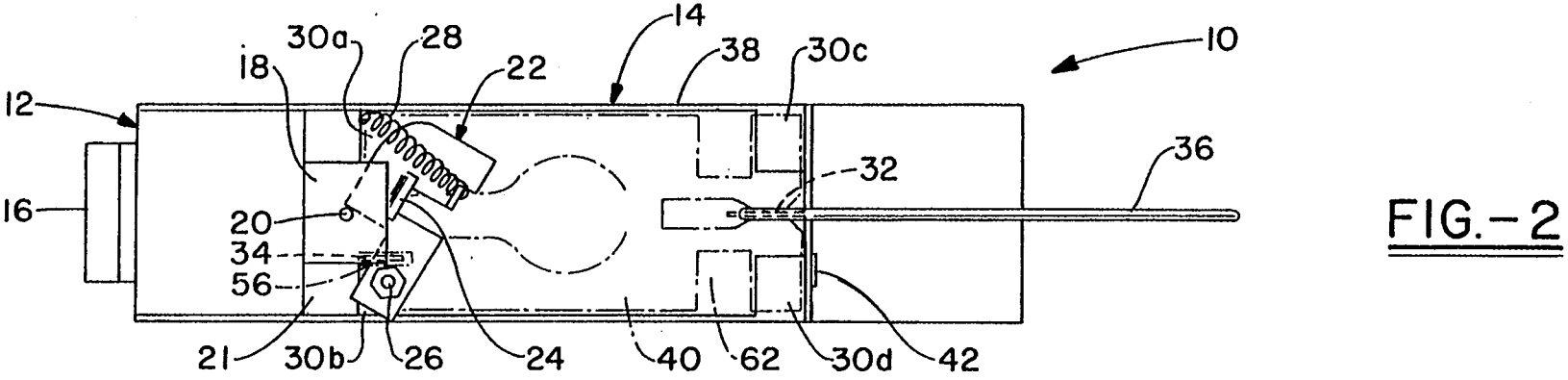
FIG. 2 is bottom view of a device shown in FIG. 1.

FIG. 2 is a bottom view of the device shown in FIG. 1. As illustrated, the vending device, generally 10, comprises a dispensing device, generally 14, connected to a coin mechanism 12, the latter being operated by rotating operating handle 16 in order to turn the operating cylinder 18 and its included coupling pin 20. As the pin is turned, it forces pivot plate 22 to rotate in a clockwise direction about pivot pin 26. In so doing, detent 24 is forced against the flap 50 of lowermost separator panel 40, shown in phantom, pushing the panel to the right. In so doing, the separator panel 40 is pushed off of the support tabs **30*a* and 30*b*, due to the action of detent 24 against the separator flap 50, the procedure being better understood by reference to FIGS. 5A–5C. Simultaneously, the separator panel support tab notches 62 of the separator panel 40 become coincident with divider support tabs 30*c* and 30*d*, allowing the panel to fall from the housing 38, being retained by divider storage hanger 36, along which they slide to a storage position, better shown in FIG. 1. Following disposal of the separator panel 40, as described, pivot plate spring 28 causes pivot plate 22 to return to its initial position, allowing a new separator panel 40 to fall onto divider support tabs 30***a*, 30*b*, 30*c*, and 30*d*, being supported thereby. Although the rectangular separator panel support tabs 30*a*–30*d* shown commonly have dimensions of about ½ inch long and ½ inch wide, support tabs having a different shape or dimensions may also be used.

Figure 3:
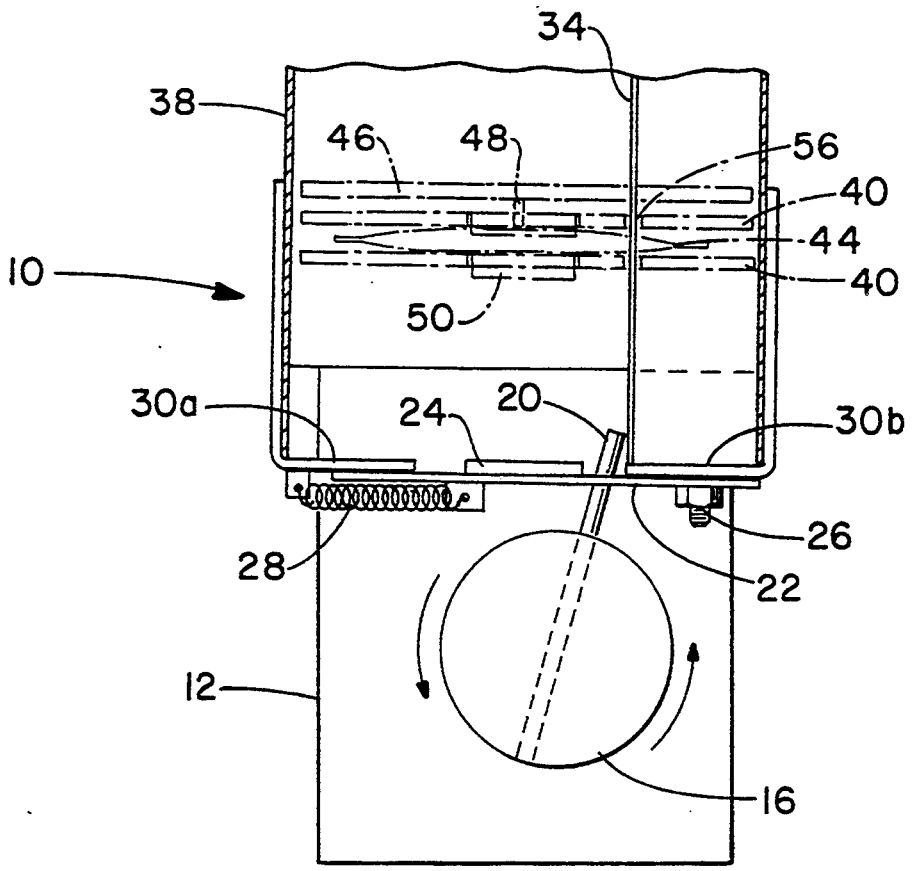
FIG. 3 is an elevational view, in partial cross-section of the device shown in FIG. 1, as taken along line 3—3 thereof.

FIG. 3 is an elevational view, in partial cross-section of the device shown in FIG. 1, as taken along line 3—3. In the Figure, separator panels 40 are shown supporting product 44, with a weight 46 thereon containing a blocking tab 48 attached thereto. The separator panels are only shown in the upper part of housing 38 so that the detail of the dispensing mechanism can be illustrated more clearly. As shown, depression of panel flap 50, against which detent 24 presses is clearly evident, as are panel support tabs 30*a*and 30*b* on which one end of the lowermost separator panel 40 is supported. The Figure also illustrates how the separator panels are guided in their descent by guide flange 34, received in guide flange slot 56.

As shown, rotation of the operating handle 16 forces coupling pin 20 against pivot plate 22 upon the insertion of proper coinage in coin mechanism 12, forcing detent 24 to advance and engage a separator panel 40, not shown. After the product has been dispensed, pivot plate spring 28 returns the pivot plate 22 to its original position.

FIG. 4 is a top plan view of a separator panel or member forming an important element of the invention. The separator panel, generally 40, shown includes a panel separator flap 50 which is depressed under the weight of the product to be vended since it is attached to the separator panel only in the vicinity of hinge point 52. The separator panel 40 also includes a guide flange slot 56, as well as a guide flange slot 58, which latter terminates in a cavity 60 which receives the storage hanger 36. Separator panel support tab notches 62 are also included in the separator 40 for the purpose of allowing the support panel to fall free from the housing 38. The separator panel flap 50 can be deflected from the plane of the separator panel 40, allowing it to be engaged by the detent 24, which is slightly bent so that it extends in the neighborhood of a 1/16 inch above the plane of the pivot plate 22.

The dimensions of the separator panels 40 will obviously depend upon the dimensions of the housing within which they are contained, as well as upon other factors; however, the depth and width of the separator panel support tab notches 62 will generally each be about ¾ inch long, but in any event will be larger than separator support tabs 30*c* and 30*d*. Guide slot 56 will conveniently be about ¾ inch long, by about ⅛ wide, while guide flange slot 58 will be about 1¾ inch long with a width varying from ⅛ inch to about ⅜ inch to accommodate guide flange 32 in its narrowest part, and storage hanger 36 in its widest part.

The overall separator panel will conveniently have a length of approximately 5¼ inches and a width of about 2½ inches. The diameter of the pan portion 54 will normally be about 1½ inches, while the flap 50 will be approximately 1⅝ inch long, by ⅝ inch wide.

The panel is conveniently made from plastic materials such as PVC, polystyrene, nylon, and the like and is sufficiently flexible so that it can be twisted to allow enough distortion of the guide flange slot 58. This is necessary when removing the separator panels 40 from the storage hanger 36 at such time as it becomes desirable to reinstall the separator panels inside housing 38 to support product 44 thereon.

Figure 5A:
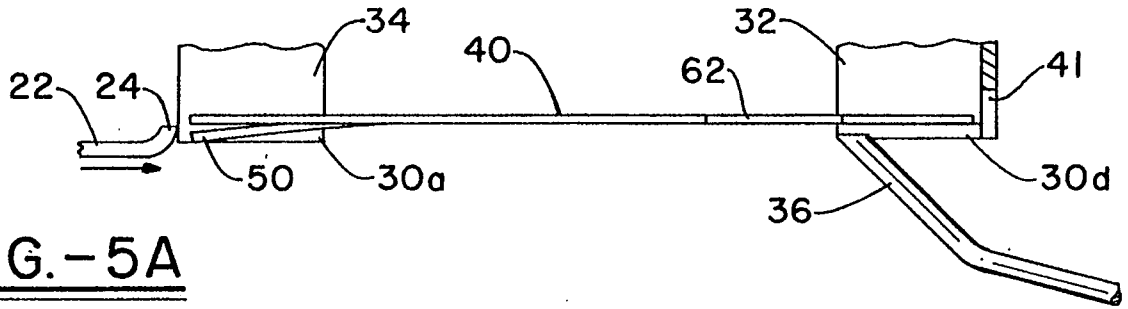
FIGS. 5A–5C are schematic side views illustrating the operation of the dispensing device.
Figure 5B:
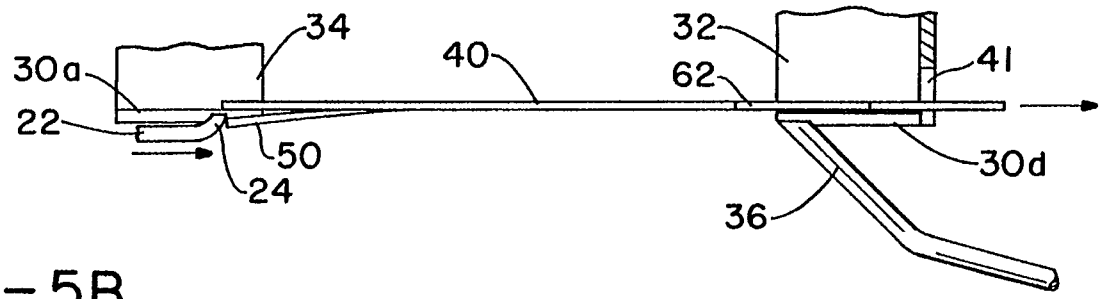
Figure 5C:
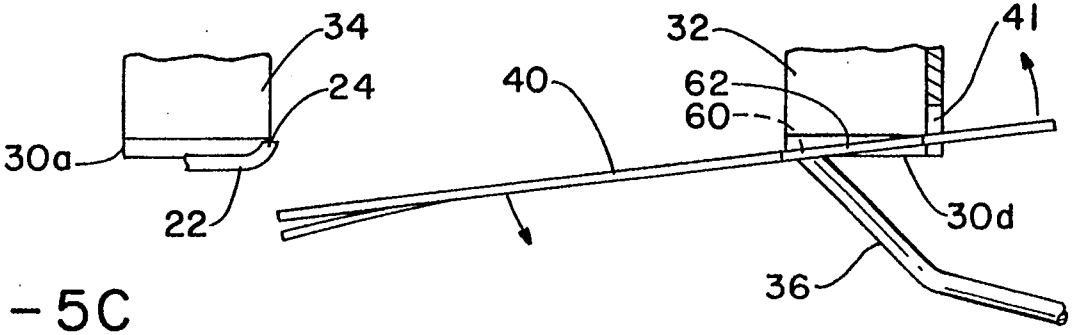

FIG. 5A–5C are schematic side views illustrating the operation of the dispensing device.

In FIG. 5A, for example, there is shown a separator panel 40 held in a proper storage position by support tabs 30*a* and 30*d*, having been guided into such position by guide flanges 32 and 34, respectively. Attached to the rear of the dispersing device 10 is a separator panel storage hanger 36. Separator flap 50 can be seen in a slightly depressed position 50 as a consequence of the weight of other separator panels, product, and the weight plate 46, none of such objects being shown. Approaching from the left and moving toward the right is pivot plate 22 with its raised detent 24 in a position to engage separator panel flap 50.

FIG. 5B illustrates the point in the vending process where detent 24 has engaged separator flap 50 and moved the separator panel 40 to the right, causing its right end to pass through exit port 41.

FIG. 5C represents the point where the separator panel 40 has fallen from separator support tabs 30*a* and 30*b*, while separator panel support tab notches 62 have become aligned with separator panel support tabs 30*c* and 30*d*, a condition in which separator panel 40 is free to fall from the dispensing device and move to a position in which the separator panel is held only by storage hanger 36. It is in this latter condition that the product is free to fall from the separator panel.

While a particular form of dislodgement means has been described entailing the action of a coupling pin 20 against a pivotal plate 22, other mechanisms for shifting separator panels 40 from their separator panel support tabs would be suitable for purposes of the invention.

Following dispensing of all product held by the support plates and its subsequent blocking of plate 22 by blocking tab 48, the machine is reloaded by simply removing the separator panels 40, one at a time, by twisting them from the storage hanger 36. This is followed by their insertion into the top of housing 38, following removal of weight 46, placing product on each of the separator panels so loaded, followed finally by re-installation of the weight.

Figure 6:
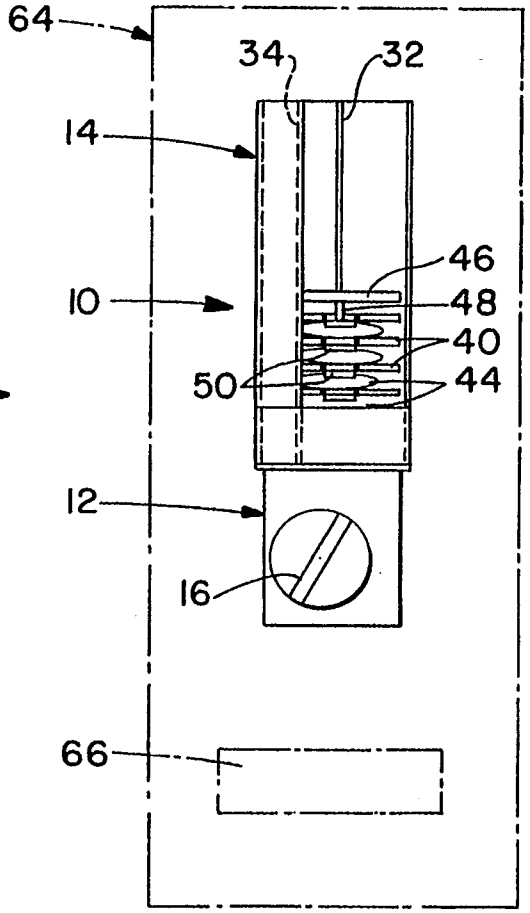
FIG. 6 is a frontal view of a product dispensing machine shown in phantom dot-dash lines, which incorporates the product dispensing device of the invention.

FIG. 6 is a frontal view of a product dispensing machine shown in phantom, dot-dash lines, which incorporates the product dispensing device of this invention. As shown, the dispensing device 10 is supported inside a support pedestal 64, the latter having a product access port 66 located therein. As previously described, the dispensing device 10 comprises alternating separator panels 40, holding the product to be dispensed 44 thereon, and holding a weight 46 on top of the product separator panel layers disposed beneath it. As the proper coins are inserted into the coin mechanism 12 and its operating handle 16 rotated, the separator panels 40 are pushed from their supported position, one at a time, allowing the product 44 to fall from the dispensing device into the access port 66. As each article of product is dispensed, the stack of product packages supported by separator panels 40 descends in the device, guided by guide flanges 32 and 34, respectively.

As previously stated, the vending device has the unusual capability of dispensing product packages having different dimensions from a single device, allowing great flexibility in the vending operation. It is also useful for vending small articles, even irregularly shaped ones, including, for example, packets of drink concentrates, such as coffee, tea, and the like. When used as a beverage dispenser, it is particularly suitable for location adjacent hot water dispensing sources to enable purchasers to prepare and consume their own beverages at the same location.

While in accordance with the patent statutes, a preferred embodiment and best mode has been presented, the scope of the invention is not limited thereto, but rather is measured by the scope of the attached claims.

What is claimed is:

1. A device for vending articles comprising:

housing means;

article separator means within said housing means, and individually removable therefrom, for supporting and separating vendable articles, said separator means being movable from a first position in which support for said separator means is provided, to a second position in which said separator means is unsupported, causing the articles supported thereby to fall from said housing means;

support means associated with said housing means for supporting said article separator means;

dislodgement means for dislodging said separator means from said support means, and means for activating said dislodgement means.

2. A device for vending articles comprising:

housing means;

article separator means within said housing means for supporting and separating vendable articles, said separator means being movable from a first position in which support for said separator means is provided, to a second position in which said separator means is unsupported, causing the articles supported thereby to fall from said housing means;

support means associated with said housing means for supporting said article separator means;

dislodgement means for dislodging said separator means from said support means, and means for activating said dislodgement means, wherein said article separator means includes:

a plurality of panels, each having a flap comprising a pivotal part thereof, and wherein said panels are adapted to support said articles and said flaps to pivot downwardly when said articles rest thereon.

3. A device according to claim 2, wherein said support means comprises support members attached to the bottom of said housing means, on which said panels rest.

4. A device according to claim 3, wherein said housing means comprises a bin having an open bottom, and said support members comprising tabs that extend into the bottom of the bin.

5. A device according to claim 4, wherein said dislodgement means comprises a dislodgement member adjacent said bin and having a detent extending therefrom, said detent being adapted to engage said downwardly pivoted flap upon activation of said dislodgement member, said engagement causing dislodgement of said panel from said tabs, whereupon said panel and said article supported thereby are released to fall from said housing means.

6. A device according to claim 5, wherein said dislodgement member is a pivot arm with said detent extending therefrom, said arm being pivotally attached to the bottom of said bin, and said arm pivoting upon the urging of a coin-operated mechanism, resulting in said engagement.

7. A device according to claim 5, wherein said bin is provided with storage means to receive said panels upon their release and to store them for reuse.

8. A device according to claim 7, wherein said storage means is a panel hanger attached to said bin, and said panels have an opening therein into which said hanger is received and held as said panels fall from said housing means.

9. A device according to claim 8, wherein said hanger is a wire, and said opening is a slot having an open exterior end, and an enclosed interior end into which latter end said wire is received and held prior to removal of said panels.

10. A device according to claim 9, wherein the interior of said bin is provided with at least one vertical guide flange and said panels have counterpart guide slots into which said flanges are inserted to guide the panels as they travel downwardly in said bin during vending.

11. A device for vending articles comprising:

a bin having an open bottom;

a plurality of panels adapted to support and separate vendable articles stored within said bin, said panels having a flap which forms a portion thereof and being a pivotal part of said panels that pivots downwardly when vendable articles rest thereon, said panels being movable from a first position in which support for said panels in said bin is provided, to a second position in which the panels are unsupported and fall from said bin, together with the vended articles;

support members for supporting said panels within said bin;

a dislodgement member having a detent extending therefrom, said detent being adapted upon activation of the dislodgement member to engage said downwardly pivoted flap, causing dislodgement of the panel from said support members and the discharge of articles supported thereby, and a coin operated mechanism for activating said dislodgement member.

12. A device according to claim 11, wherein said bin is rectangular and said support members comprise tabs at the bottom of the bin that extend into the bin from the corners thereof.

13. A device according to claim 12, wherein said dislodgement member comprises a pivotal member adjacent to the bottom of said bin, pivoted by its engagement with said coin operated mechanism, said pivotal member having a detent extending therefrom adapted to engage said downwardly pivoted flap and to dislodge said panel from said support members.

14. A device according to claim 13, wherein said bin has a panel hanger attached thereto, and said panels have an opening therein into which said hanger is received and held as said panels fall from said housing means, said hanger providing storage for the panels until their removal from the hanger and reuse.

15. A device according to claim 14, wherein the interior of said bin is provided with at least one vertical guide flange, and said panels have counterpart guide slots into which said flanges are inserted to guide the panels as they travel downwardly in said bin during vending.

* * * * *